United States Patent [19]

Meier

[11] 4,416,448

[45] Nov. 22, 1983

[54] METHOD AND APPARATUS FOR THE INSERTION OF AT LEAST ONE INSERT OR SUPPLEMENT INTO PRINTED PRODUCTS

[75] Inventor: Jacques Meier, Bäretswil, Switzerland

[73] Assignee: Ferag AG, Hinwil, Switzerland

[21] Appl. No.: 316,435

[22] Filed: Oct. 29, 1981

[30] Foreign Application Priority Data

Nov. 17, 1980 [CH] Switzerland ..... 8496/80

[51] Int. Cl.[3] ..... B65H 5/30

[52] U.S. Cl. ..... 270/55; 270/57

[58] Field of Search ..... 270/54–57

[56] References Cited

U.S. PATENT DOCUMENTS 3,692,301 9/1972 Wetter ..... 270/55
3,789,571 2/1974 Tall ..... 270/57 X
3,951,399 4/1976 Reist ..... 270/55 X

FOREIGN PATENT DOCUMENTS 376940 4/1964 Switzerland ..... 270/55

*Primary Examiner*—A. J. Heinz
*Attorney, Agent, or Firm*—Werner W. Kleeman

[57] ABSTRACT

In each case two printed products conjointly travel through a processing path which starts at an input or infeed section and terminates at a removal or withdrawal section. At the infeed section an opening is produced in one of these printed products by the action of a pressure element which exerts a pressure or force transversely with respect to the plane of the printed products. During the forward advance of the printed products in a subsequently arranged feed section the opened printed product travels onto a separation element, such as a separation wedge, by means of which such printed product is opened. There is stuffed an insert into the opened printed product. At this first feed section the other printed product, which up to this time merely travelled along, is opened by means of a further pressure element. During the further advance of the printed products the second printed product is likewise opened by a separation element, for instance a separation wedge, which engages into the previously formed opening of this other printed product. At a second feed section there is now likewise stuffed an insert into the open second printed product. The final products, each of which have been provided with a respective insert, are now removed from the removal section for further processing. With a given processing speed the output of the equipment is increased due to the simultaneous travel or passage of two printed products through the stuffing device.

16 Claims, 9 Drawing Figures

METHOD AND APPARATUS FOR THE INSERTION OF AT LEAST ONE INSERT OR SUPPLEMENT INTO PRINTED PRODUCTS

CROSS-REFERENCE TO RELATED APPLICATIONS

This application is related to the commonly assigned, copending U.S. application Ser. No. 06/214,461, filed Dec. 8, 1980, and entitled "Apparatus For Opening Folded, Bound or Stitched Multi-Sheet Products, Especially Printed Products", and to the commonly assigned, copending U.S. application Ser. No. 06/214,460, filed Dec. 8, 1980, now U.S. Pat. No. 4,398,710 and entitled "Method and Apparatus for Opening Folded, Bound or Stitched Multi-Sheet Products, Especially Printed Products".

BACKGROUND OF THE INVENTION

The present invention relates to a new and improved method of, and apparatus for, the insertion or stuffing of at least one insert into printed products and, in particular, concerns a method and apparatus for the stuffing of at least one insert into folded primary printed products or sections.

In German Patent Publication No. 2,447,336 and the corresponding U.S. Pat. No. 3,951,399 there has become known in this technology a stuffing machine containing a rotatably driven cell wheel. This cell wheel possesses radially extending compartments for the reception and processing of in each case a printed product. During the rotation of the cell wheel the printed products are forwardly advanced in its axial direction from an infeed location to a removal location. Along the processing path each printed product is initially opened and then furnished with an insert. This stuffing machine, notwithstanding its high output or production capacity, is not capable in certain situations of adequately processing all of the inbound or arriving printed products, since, for instance, an increase of the processing speed of the printed products is subjected to certain limitations. When this situation is encountered it is then necessary to provide two parallely operating stuffing machines. Apart from the need for the increased amount of space there is also disadvantageously associated with this solution the increased costs for the additional stuffing machine.

SUMMARY OF THE INVENTION

Therefore, with the foregoing in mind it is a primary object of the present invention to provide a new and improved method of, and apparatus for, stuffing or insertion of at least one insert into printed products in a manner not associated with the aforementioned limitations and drawbacks of the prior art proposals.

Another and more specific object of the present invention aims at providing a new and improved method of, and apparatus for, stuffing inserts into printed products in a manner affording an appreciable increase in the production capacity of the equipment during the processing of the printed products, without the need for resorting to complicated measures or the requirement for a corresponding increase in the processing speed.

Yet a further significant object of the present invention is directed to a new and improved apparatus for the stuffing of at least one insert into printed products or the like, which apparatus is relatively simple in construction and design, extremely reliable in operation, not readily subject to breakdown or malfunction, requires a minimum of maintenance and servicing, and affords a high production capacity.

Now in order to implement these and still further objects of the invention, which will become more readily apparent as the description proceeds, the method aspects of the present development are manifested by the features that in each case at least two printed products are moved while reposing upon one another conjointly along the processing path.

As indicated heretofore the invention is not only concerned with the aforementioned method aspects, but also pertains to apparatus for the performance thereof. According to a preferred construction of the inventive stuffing apparatus for stuffing at least one insert into the printed products, especially for stuffing at least one insert into folded primary printed product sections, there is provided a conveyor device for transporting the printed products along a processing path, and an arrangement for opening the printed products during the time of their transport. Additionally there are provided infeed means for introducing the inserts into an opening formed in the printed products. According to important aspects of the invention the conveyor device in each instance conveys at least two printed products while reposing or lying upon one another conjointly along their processing path, and each of the conjointly moved printed products has operatively correlated therewith an opening device and at least one infeed device for an insert.

By virtue of the fact that two or, if desired, even more printed products conjointly pass through the processing path, it is possible, with the same processing speed or velocity per unit of time, to process more products than was possible with the heretofore known prior art solutions. In order to be able to furnish the printed products which are reposing or lying upon one another with the insert or, if desired, the inserts in a positive manner and without the need for reducing the processing speed, the printed products are preferably successively opened. In this way the opening and subsequent stuffing of the inserts can be accomplished in a faultless manner through the use of relatively simple or uncomplicated means.

Since the inserts can be stuffed or introduced into the printed products independently of one another, it is readily possible to stuff a different type of insert into each of the printed products. At the end of the processing path the printed products furnished with the inserts can again be conjointly outfed or removed.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Describing now the drawings, it is to be understood that only enough of the details of the construction of the stuffing apparatus of the present development have been shown in order to enable those skilled in this art to readily understand the underlying principles and concepts of the present development. Turning attention now specifically to FIGS. 1 and 2, there is schematically illustrated therein a stuffing apparatus 1 which extensively is of known construction and has been described in detail of the aforementioned German Patent Publication No. 2,447,336 and the cognate U.S. Pat. No. 3,951,399, to which reference may be readily had and the disclosure of which is incorporated herein by reference. For that reason the description to follow will generally confine itself to those important features of the known construction and known mode of operation of the prior art stuffing machine as is needed for comprehending the underlying principles of the invention.

Figure 1:
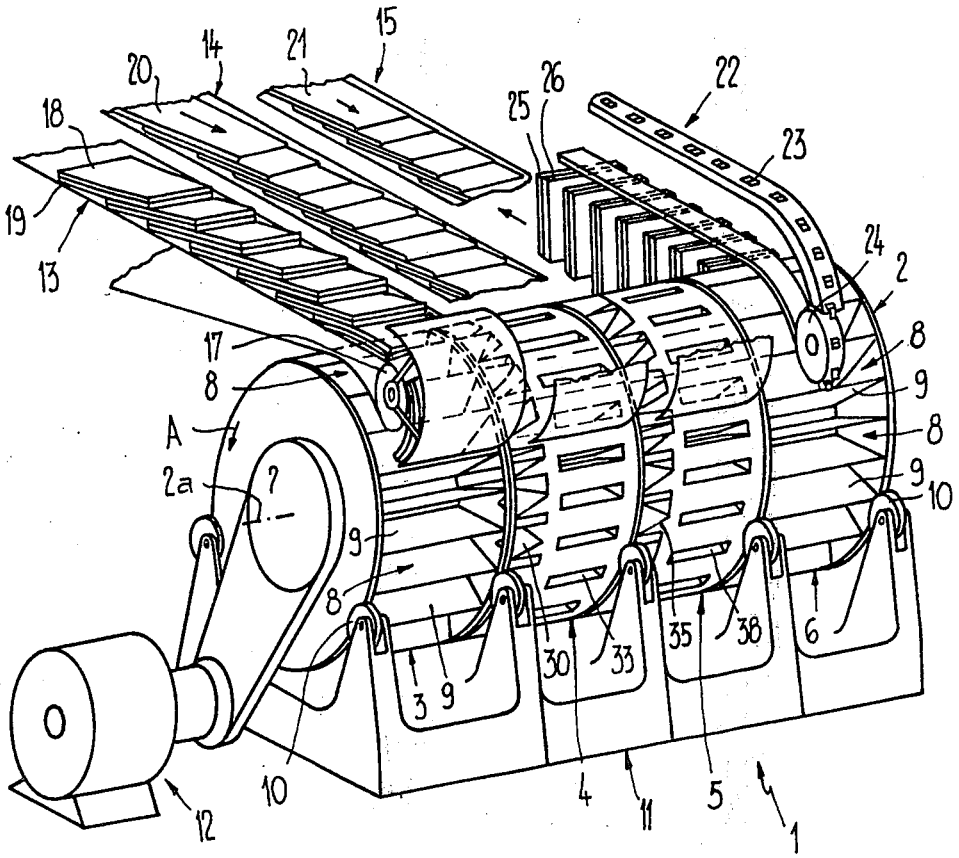
FIG. 1 is a simplified perspective view of an apparatus for stuffing inserts into primary or main printed products or product sections and constructed according to the invention.

One of the most important parts of the stuffing apparatus 1 is its lengthwise extending cell wheel 2 having an essentially horizontal axis. This cell wheel 2 is subdivided into a number of sections or portions 3, 4, 5 and 6 which are arranged adjacent one another in the direction of the lengthwise axis 2*a* of the cell wheel 2 and are rigidly connected for rotation with one another. At an infeed or input section 3 there merge two feed sections or portions 4 and 5 and a removal or discharge section 6. Each cell wheel section 3, 4, 5 and 6 possesses radial outwardly open compartments 8 which are separated from one another by partition or separation walls 9. The cell wheel 2 is supported upon rolls 10 which are mounted to be freely rotatable in a frame or support arrangement 11. As schematically indicated in FIG. 1, the cell wheel 2 is driven by a drive 12 in the direction of the arrow A in order to rotate about its lengthwise axis 2*a*.

Figure 2:
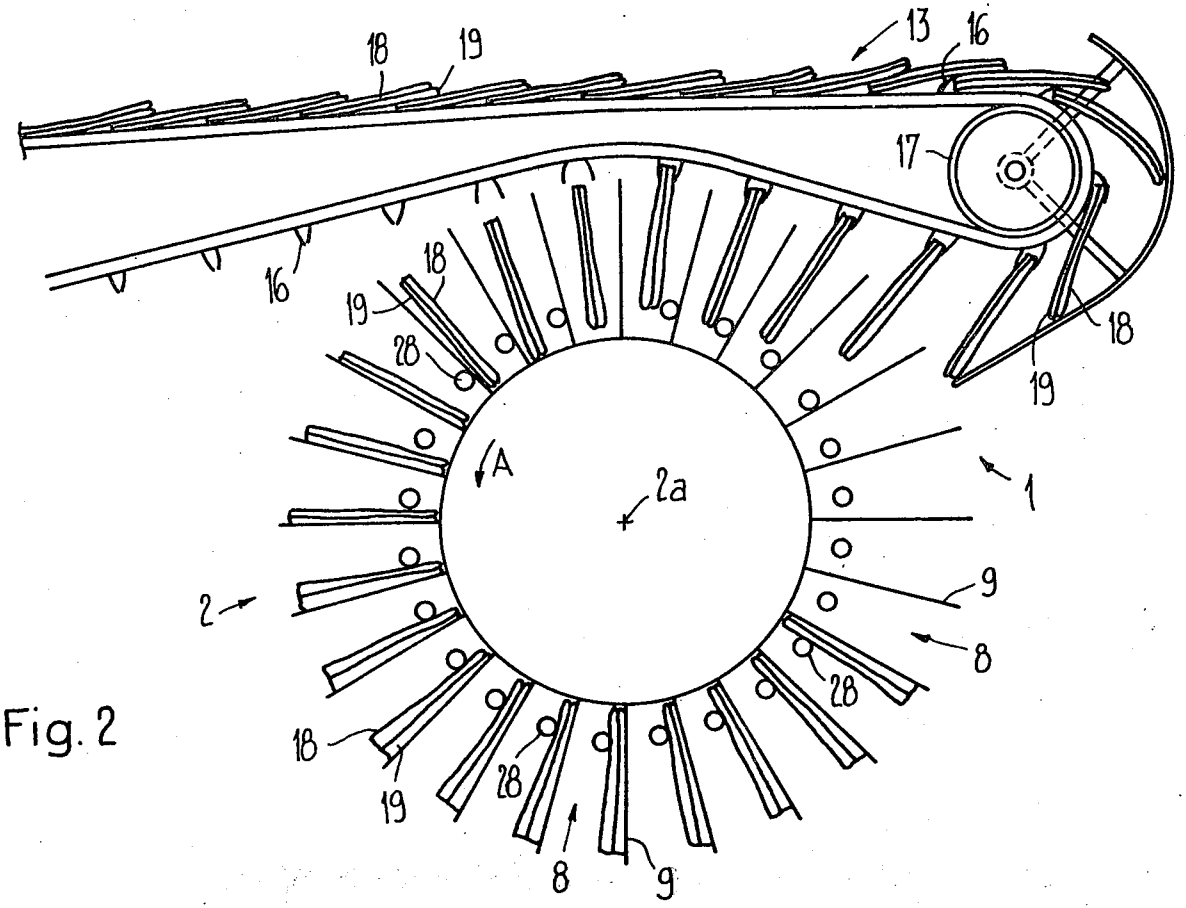
FIG. 2 is a schematic side view of the stuffing apparatus shown in FIG. 1.

Leading to each infeed section 3 and each feed section 4 and 5 is a respective transport or conveying device 13, 14 and 15. These transport or conveying devices 13, 14 and 15 are arranged above the related cell wheel section 3, 4 and 5 and extend towards such corresponding section. As particularly well seen by referring to the transport or conveying device 13 shown in FIGS. 1 and 2, each transport or conveying device 13, 14 and 15 is equipped with clamping elements or tongues 16 arranged in spaced relationship from one another. Each transport or conveying device 13, 14 and 15 is guided about a deflection roll 17. The transport or conveying device 13 serves the purpose of infeeding in each case two superimposed primary printed products or main product sections 18 and 19 into the infeed or input section 3 of the cell wheel 2. The primary products 18 and 19 are arranged upon the transport or conveying device 13 in an imbricated formation, as particularly shown in FIG. 1. The clamp tongues or elements 16 engage the printed products 18 and 19 at their rear edge, viewed with respect to the conveying direction, i.e. at the region of the so-called flower or cut portion of the printed products. As shown in FIG. 2, the printed products 18 and 19, after travelling about the deflection roll 17, assume a depending or suspended position where they extend into the related compartment 8 of the infeed section 3. Upon opening the clamp elements or tongues 16—also referred to as clamping jaws—, there are released the printed products 18 and 19. Consequently, the related pair of printed products 18 and 19 drop onto the not particularly referenced base or floor of the related compartment 8. In corresponding manner there is infed to each of the infeed sections 4 and 5, by means of the transport of conveying devices 14 and 15 the respective pre-products 20 and 21, also referred to sometimes as inserts or supplements.

An overhead transport or conveying device 22 is also operatively associated with the removal or withdrawal section 6 of the cell wheel 2. This transport or conveying device 22 likewise is equipped with clamping elements or jaws 23 arranged at a mutual spacing from one another and is guided about a deflection roll 24. The clamping elements or jaws 23 engage in known manner in each case both of the end products 25 and 26 which are lying or reposing upon one another in a compartment 8 at the removal section 6 and lift such end products 25 and 26 out of the compartments 8. The end products 25 and 26 which, as shown in FIG. 1, are further transported in a depending or hanging position, now can be further processed.

In each compartment 8 of the infeed section 3 there are thus inserted two primary or main printed products 18 and 19. As will be explained more fully hereinafter, these primary products 18 and 19 are shifted conjointly, while lying or reposing upon one another, in the axial direction of the cell wheel 2 towards the removal section 6. During the course of this movement there is stuffed into each of the printed products 18 and 19 a related insert 20 and 21, respectively. The end products 25 and 26 provided with such inserts are again conjointly removed out of the removal or withdrawal section 6 of the cell wheel 2.

Figure 3:
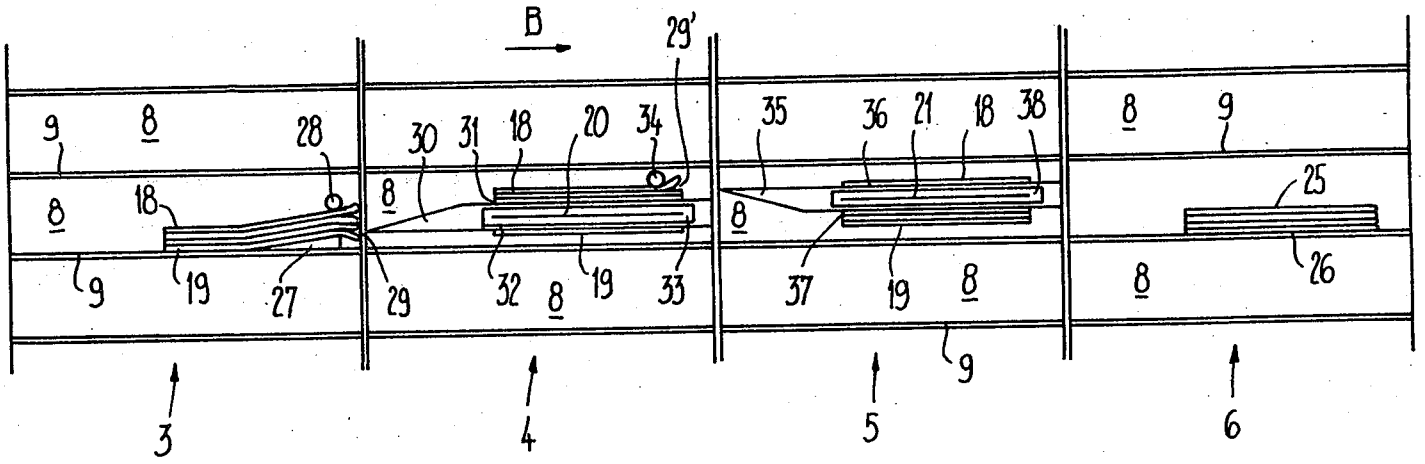
FIG. 3 is a top plan view of part of a cell wheel used in the stuffing apparatus according to FIG. 1, wherein there has been shown in a timewise staggered fashion the course of the stuffing operation.

Based upon the illustration of FIG. 3 there will now be explained in greater detail the opening and stuffing operation. With the illustration as depicted in FIG. 3 the rotation of the cell wheel 2 has not been taken into account. In reality, however the printed products 18 and 19 do not move, as has been shown for simplification purposes in the illustration, along a straight path of travel, rather along a helical or screw-like shaped travel path. The conjoint advance or feed of the printed products 18 and 19 from the infeed section 3 to the removal or withdrawal section 6 is accomplished in the manner disclosed in the previously mentioned German Patent Publication No. 2,447,336 and the corresponding U.S. Pat. No. 3,951,399 or in the manner disclosed in the German Patent Publication No. 2,604,101 and the corresponding U.S. Pat. No. 4,058,202. As to the construction and mode of operation of the conveying device for advancing or feeding the printed products 18 and 19, and which has not been particularly illustrated in the drawings since such structure is known and unimportant for understanding the principles of the invention, reference therefore may be had to the previously mentioned prior art patents.

The printed products 18 and 19 which are inserted in the manner described in conjunction with the description of FIG. 2 into the compartments 8 of the infeed or input section 3, during rotation of the cell wheel 2, come to bear upon a compartment partition or separation wall 9, as the same has been shown in FIGS. 2 and 3. Attached to this partition or separation wall 9 is a substantially wedge-shaped support element 27 by means of which the thereat supported or reposing printed products 18 and 19 can be raised somewhat from the partition wall 9 at their leading region, as best seen by referring to FIG. 3. In each compartment 8 of the infeed section 3 there is arranged a pressure element 28 which, in known manner, during the course of the rotational movement of the cell wheel 2, moves against the printed products 18 and 19 and exerts a force or pressure thereat. This pressure or force which is directed transversely with respect to the plane of the printed products 18 and 19 exerts an opening action at the printed products 18 and 19 at their leading open side edges, again as will be seen by referring to FIG. 3. The opening which is thus formed in the printed product 19 has been conveniently designated by reference character 29.

The printed products 18 and 19, during their conjoint advance or feed in the direction of the arrow B, arrive at the neighbouring compartment of the feed section or portion 4. In each compartment 8 of this feed section 4 there is located a stationary separation element 30, here in the form of a separation wedge, onto which travels the printed product 19. This separation wedge 30 engages into the opening 29 of the printed product 19 and, during the further transport of the printed products 18 and 19, accomplishes a complete opening of both halves of the printed product 19. By means of guide elements 31 and 32, for instance in the form of sheet metal guides, which follow the separation or spreading wedge 30, the printed product 19 is maintained in its open position. Into an insertion opening 33 which opens into the space formed between the sheet metal guide members 31 and 32 there is now introduced an insert 20 into the open printed product 19.

During the opening of the printed product 19 and the stuffing of the insert 20 there is conveyed along with the printed product 19 the other printed product 18, without such printed product 18 being subjected at this time to a specific processing operation. After or during the stuffing of the insert 20 into the printed product 19 there is then accomplished a pre-opening of the second printed product 18 by means of a pressure element 34 arranged at the compartments 8 of the feed section 4. This pressure element 34, just as was the case for the pressure element 28, likewise exerts a force or pressure which is effective transverse to the plane of the printed product 18. By means of this pressure or force there is formed at the leading edge of the printed product 18 an opening 29' between both halves of such printed product 18. During the conjoint further movement of both printed products 18 and 19 the printed product 18 travels onto a separation element 35, again in the form of a separation wedge, which is arranged at the neighbouring compartment 8 of the second feed section 5. This separation wedge 35, just as was the case for the previously described separation wedge 30, moves into the opening 29' of the printed product 18 and causes a complete opening of this printed product 18 which is then maintained in its open state or condition by the guide elements 35, 36 and 37, again for instance sheet metal guides, arranged following the separation or spreading wedge 35. An insert or supplement 21 or equivalent structure is stuffed into the open printed product 18 through the infeed opening 38 which communicates with the space formed between the guide elements 36 and 37. During the forward feed or advance of the printed products 18 and 19 from the feed section 4 into the feed section 5 the printed product 19 moves out of the operative region of the guide elements 31 and 32 and is again closed.

From the location of the infeed section 5 both of the printed products 19 and 18 provided with the respective insert 20 and 21 are transported to the removal section 6, and during this displacement the printed product 18 travels off of the guide members 36 and 37 and closes. The end products 25 and 26 which lie or repose upon one another are then, as already explained, removed out of the compartment 8 of the removal or withdrawal section 6 by the transport or conveying device 22 and transported away.

As will be apparent from the previous description, both of the printed products 18 and 19 are moved conjointly along their processing path, but however opened successively and provided with an insert. The opening and stuffing is accomplished for both printed products 18 and 19 in conventional manner, as for instance described in detail in the previously referred to German Patent Publication No. 2,447,336 and the cognate U.S. Pat. No. 3,951,399. However, it is also conceivable to form with the aid of other means the opening 29 and 29' between the sheets of the printed products 19 and 18, respectively. This pre-opening of the printed products 18 and 19 can be accomplished, for instance also in the manner described in German Pat. No. 2,136,227 and the cognate U.S. Pat. No. 3,692,301, or in the manner disclosed in the German Patent Publication No. 3,047,437 or the corresponding British Patent Publication No. 2,067,171 or the cognate copending U.S. application Ser. No. 06/214,461, filed Dec. 8, 1980, the disclosure of which is incorporated herein by reference.

Now in conjunction with FIG. 3 there has been explained the processing of double-folded printed products which possess a certain thickness. Based upon FIGS. 4 and 5 there will be described hereinafter the processing of thin products containing a pre-fold, such as tabloids.

Figure 5:
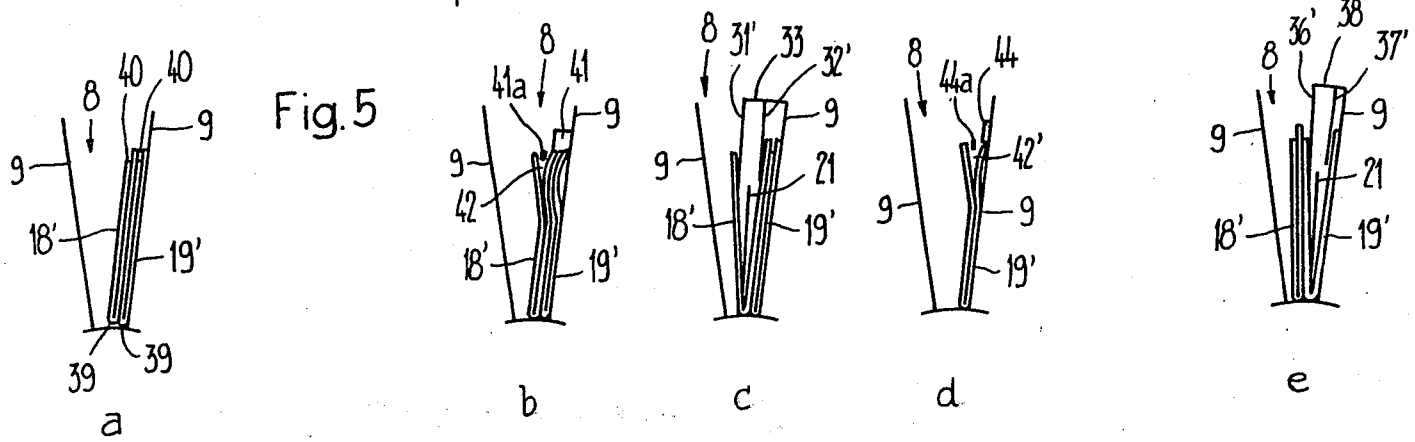
FIGS. 5*a*, 5*b*, 5*c*, 5*d* and 5*e* are respective schematic sectional views taken along the lines a—a, b—b, c—c, d—d, and e—e of FIG. 4.

With such products containing a pre-fold, and as is well known, one-half of each printed product 18' and 19' protrudes at the open side 40 (the flower or cut portion), situated opposite the folded edge 39, past the other half of the printed product, as the same has been particularly well shown in the sectional illustration of FIG. 5. The introduction of the printed products 18' and 19' containing a pre-fold into the compartments 8 of the infeed or input section 3, the transport of such printed products 18' and 19' in the feed or advance direction B, the stuffing of the inserts 20 and 20' and the removal of the final or end products 25' and 26' from the removal or withdrawal section 6, is accomplished in the manner heretofore described in detail. Only the pre-opening of such printed products 18' and 19' is accomplished in a different manner than that described in conjunction with FIG. 3.

Figure 4:
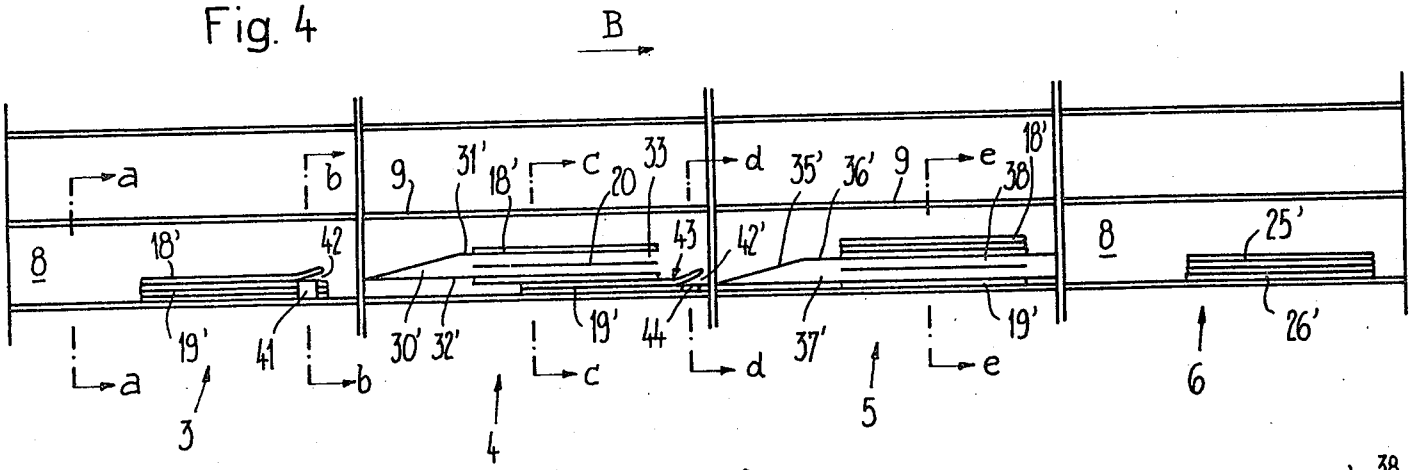
FIG. 4 is an illustration, similar to the showing of FIG. 3, of a cell wheel for processing a different type of printed products.

In the compartments 8 of the infeed section 3 there is provided an opening element 41 of known construction and which has only been schematically shown in FIGS. 4 and 5. As to the exact structure and mode of operation of this opening element 41 reference can be had to German Patent Publication No. 3,047,436, the cognate British Patent Publication No. 2,066,790 and the likewise corresponding, copending U.S. application Ser. No. 06/214,460, filed Dec. 8, 1980, the disclosure of which is incorporated herein by reference. As particularly apparent by referring to FIG. **5*b*, this opening element 41** brings about a doming-out or bulging apart of the sheets of the printed product 18', so that there is formed an opening 42 between both halves of such printed product 18'. By means of a holder element 41*a* shown in FIG. 5*b*, which engages between both halves of the printed product 18', there is maintained in an open condition the opening 42 during the entire transport of the printed products 18' and 19' in the feed or advance direction B. Upon entry of the printed products 18' and 19' into the neighbouring compartment 8 of the feed section 4 the printed product 18' is opened by means of the separation wedge 30' which is introduced into the opening 42. An insert 20 is stuffed through the insertion or stuffing opening 33 into the printed product 18' which is maintained in an open condition by the sheet metal guide elements 31' and 32', as the same has already been described in conjunction with FIG. 3. During the opening of the printed product 18' and the stuffing of the insert 20 and the like the other printed product 19' is moved along with the printed product 18' without being exposed to any processing operation.

Now in order to be able to open the printed product 19' there must be exposed the region of a side edge of such printed product 19'. In the illustrated exemplary embodiment there is exposed or laid free the leading edge 43. However, it is also possible to expose a side edge extending transversely to such leading edge 43. The relative displacement between the printed products 18' and 19', which is needed in order to render freely accessible the edge 43 of the printed product 19', in the embodiment under discussion is realized in that, the printed product 18' is entrained by a certain amount by the return moving feed device, whereas the other printed product 19' is prevented from being entrained for movement in a direction towards the infeed section 3 by a stop over which travels such other printed product 19'. It should be explicitly understood, however, that this mutual displacement of the printed products 18' and 19' can also be accomplished in a different manner.

An opening element 44 arranged at the compartments 8 of the feed section 4 acts upon the region of the freely exposed edge 43. This opening element 44 is constructed in the same manner as the opening element 41 and causes, like the opening element 41, a bowing-out or doming of one-half of the printed product 19',so that there is formed between both product halves an opening 42', as shown in FIG. 5*d*. By means of a holder or hold-open element 44*a* this opening 42' is maintained in its open condition during the further transport of the printed products 18' and 19'. By means of the separation wedge 35' arranged at the neighbouring compartment 8 of the second feed section 5 there is now opened the printed product 19' and retained in its open state by the sheet metal guide elements 36' and 37'. An insert 21 or the like is stuffed through the infeed opening 38 into the open printed product 19'. The final or end products 25' and 26' which are each provided with a stuffed insert 20 and 21, respectively, thereafter arrive at the removal or withdrawal section 6 from which they are outwardly transported in the previously described manner.

It is also conceivable to displace towards one another both of the printed products 18' and 19' already in the compartment 8 of the infeed section 3, in order to freely expose an edge of the printed product 19'. In this case initially the printed product 19' is opened and provided with an insert, whereupon the product 18' is exposed to the processing cycle herein described.

Although it is not absolutely necessary, in certain situations it can also be advantageous during the processing of thick printed products 18 and 19 according to FIG. 3, to expose an edge of one printed product by mutually displacing the printed products.

As described, two or more possibly even more printed products 18 and 19 simultaneously travel through the stuffing apparatus, thereby affording for a given processing speed or velocity of the equipment a corresponding increase in the production output or capacity. Since the printed products are not conjointly, rather successively opened and provided with an insert, there is ensured for a faultless opening of the printed products nothwithstanding the conjoint throughpass of the printed products. The infeed of the inserts 20 and 21 which is accomplished for both printed products 18 and 19 independently of one another renders it possible, without the need to resort to considerable expenditure in equipment or complicated operations, stuffing into both printed products 18 and 19 different types of inserts 20 and 21.

In the event that it is desired for more than two printed products to travel conjointly through the processing path in the described manner, then there are to be provided corresponding further feed sections containing appropriate opening devices. The same is also true if each printed product is to be provided with more than a single insert or supplement. In such case it is advantageous to stuff in succession the inserts for each printed product, as the same has been disclosed in the previously referred to German Patent Publication No. 2,447,336 and the cognate U.S. Pat. No. 3,951,399.

In principle, the inserts 20 and 21 may be of random type, especially they may also be constituted by printed products. It is to be understood that not only single-part inserts 20 and 21 can be stuffed. Especially in the case of printed products it is possible to infeed to the feed sections 4 and 5 multi-sheet inserts 20 and 21 which previously have been assembled together at a collating or assembly device from individual pages or sheets.

From the previous description it will be readily apparent that the described processing of the printed products 18 and 19 is not limited to the described type of stuffing machine. Instead of using a cell wheel 2 it is possible to use also other types of equipment where the printed products 18 and 19 pass through a linear, circular or other configured two dimensional processing path.

Although as explained the printed products are preferably opened in succession, in certain instances it is equally possible to accomplish a simultaneous opening of the printed products.

While there are shown and described present preferred embodiments of the invention, it is to be distinctly understood that the invention is not limited thereto, but may be otherwise variously embodied and practiced within the scope of the following claims. Accordingly,

What I claim is:

1. A method for stuffing at least one insert into printed products, especially for stuffing at least one insert into folded primary printed products wherein each printed product is composed of at least one sheet panel folded over on itself to present two planar outside surfaces, comprising the steps of:

bringing together at least two printed products in a superposed relationship, wherein the printed products are in side-by-side relationship with their outside surfaces juxtaposed one another;

moving said superposed printed products conjointly along a common processing path;

opening each superposed printed product during their conjoint movement along their processing path after the latter have been brought together in their superposed relationship; and stuffing inserts into an opening of each printed product which has been opened.

2. The method as defined in claim 1, further including the steps of:

successively opening and providing with the inserts the printed products during their movement along the processing path.

3. The method as defined in claim 2, further including the steps of:

freely exposing at least one edge of one of the printed products; and said step of freely exposing at least one edge of one of the printed products entailing mutually displacing the printed products reposing upon one another during the course of their movement along the processing path.

4. The method as defined in claim 1, further including the steps of:

freely exposing at least one edge of one of the printed products; and said step of freely exposing at least one edge of one of the printed products entailing mutually displacing the printed products reposing upon one another during the course of their movement along the processing path.

5. An apparatus for stuffing at least one insert into printed products, especially for stuffing at least one insert into folded primary printed products wherein each printed product is composed of at least one sheet panel folded over on itself to present two planar outside surfaces, comprising:

means for transporting the printed products along a processing path;

means for successively feeding at least two printed products in superposed relationship to said transporting means;

said transporting means conjointly moving at least two of said superposed printed products such that the products are in side-by-side relationship with their outside surfaces juxtaposed one another while moving along their common processing path;

means for opening each printed product while in their superposed relationship during their transport along said processing path;

said opening means being arranged downstream of said feeding means viewed in the direction of movement of said superposed printed products;

said opening means comprising an opening device provided for each of the conjointly moved printed products;

means for infeeding at least one insert into an opening formed at each opened printed product; and said infeeding means comprising at least one infeed device associated with each printed product for infeeding an insert for stuffing into the associated opened printed product.

6. An apparatus as defined in claim 5 wherein:

said opening means and said at least one infeed device are arranged in succession in the direction of movement of the printed products.

7. The apparatus as defined in claim 5 or 6, further including:

means for displacing the printed products relative to one another during the course of their movement along the processing path for the purpose of exposing at least one edge of one of the printed products.

8. The apparatus as defined in claim 7, further including:

an outfeed device for the simultaneous removal of the printed products provided with inserts and which are reposing upon one another at a removal location;

said infeed device and said outfeed device comprise a respective conveyor device; and each of said conveyor devices possessing controlled clamping elements arranged in spaced relationship from one another and each serving for seizing at least two printed products.

9. The apparatus as defined in claim 5, further including:

an outfeed device for the simultaneous removal of the printed products provided with inserts and which are reposing upon one another at a removal location.

10. The apparatus as defined in claim 9, wherein:

said infeed device and said outfeed device comprise a respective conveyor device; and each of said conveyor devices possessing controlled clamping elements arranged in spaced relationship from one another and each serving for seizing at least two printed products.

11. The apparatus as defined in claim 5 further including:

means for infeeding at the same time at least two printed products to an infeed location.

12. The apparatus as defined in claim 5, wherein:

each opening device possesses a pre-separator element effectuating a lifting of part of the sheets of the related printed product from the remaining sheets thereof.

13. The apparatus as defined in claim 12, further including:

a separation element arranged after each pre-separator element, viewed in the direction of travel of the printed products; and said separator element being introducible into an opening between the sheets and which is formed by the pre-separator element.

14. The apparatus as defined in claim 13, wherein:

said separator element comprises a separator wedge.

15. The apparatus as defined in claim 5, wherein:

said means for transporting the printed products comprises a rotatably driven cell wheel;

said cell wheel having radially extending compartments for the reception of the printed products; and said printed products being movable in the direction of an axis of rotation of the cell wheel.

16. The apparatus as defined in claim 15, wherein:

said cell wheel is structured such that it is subdivided into sections which follow one another in axial direction of said cell wheel;

one of said sections defining an infeed section and another of said sections a removal section; and at least two feed sections for the inserts being arranged between said infeed section and said removal section.

* * * * *